US008668477B2

(12) United States Patent
Wu et al.

(10) Patent No.: US 8,668,477 B2
(45) Date of Patent: Mar. 11, 2014

(54) SERIES-CONNECTED FAN UNIT

(75) Inventors: Zhe-Hao Wu, Kaohsiung (TW); Cheng-Te Liu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 271 days.

(21) Appl. No.: 13/029,191

(22) Filed: Feb. 17, 2011

(65) Prior Publication Data

US 2012/0171057 A1 Jul. 5, 2012

(30) Foreign Application Priority Data

Dec. 31, 2010 (TW) ..... 99147314 A

(51) Int. Cl.
*F04B 35/04* (2006.01)

(52) U.S. Cl.
USPC ..... 417/423.5; 417/423.14

(58) Field of Classification Search
USPC ..... 417/423.5, 423, 14, 423.1
See application file for complete search history.

(56) References Cited

U.S. PATENT DOCUMENTS

| | | | | |
|---|---|---|---|---|
| 6,904,960 | B1 * | 6/2005 | Su et al. | 165/122 |
| 7,607,887 | B2 | 10/2009 | Yang et al. | |
| 7,659,649 | B2 | 2/2010 | Lin et al. | |
| 7,800,263 | B2 * | 9/2010 | Horng et al. | 310/67 R |
| 8,007,234 | B2 * | 8/2011 | Yoshida | 415/222 |
| 8,079,801 | B2 * | 12/2011 | Yoshida et al. | 415/66 |
| 8,177,530 | B2 * | 5/2012 | Horng et al. | 417/423.7 |
| 2007/0020128 | A1 * | 1/2007 | Chang et al. | 417/423.5 |
| 2007/0145842 | A1 | 6/2007 | Zhu et al. | |
| 2007/0152536 | A1 * | 7/2007 | Chuang et al. | 310/268 |
| 2008/0008576 | A1 * | 1/2008 | Hong et al. | 415/68 |
| 2008/0138191 | A1 * | 6/2008 | Chang et al. | 415/98 |
| 2008/0279694 | A1 * | 11/2008 | Chou et al. | 416/244 R |
| 2008/0286135 | A1 * | 11/2008 | Yoshida et al. | 417/423.5 |
| 2009/0148311 | A1 * | 6/2009 | Yoshida et al. | 417/244 |
| 2009/0155104 | A1 * | 6/2009 | Takeshita et al. | 417/423.5 |
| 2009/0189492 | A1 * | 7/2009 | Horng et al. | 310/67 R |
| 2010/0266388 | A1 * | 10/2010 | Kim | 415/119 |
| 2010/0316514 | A1 * | 12/2010 | Horng | 417/422 |
| 2012/0039729 | A1 * | 2/2012 | Horng et al. | 417/410.1 |

FOREIGN PATENT DOCUMENTS

| | | |
|---|---|---|
| CN | 201526476 U | 7/2010 |
| TW | I322655 | 3/2010 |

* cited by examiner

*Primary Examiner* — Devon C Kramer
*Assistant Examiner* — Lilya Pekarskaya
(74) *Attorney, Agent, or Firm* — Alan Kamrath; Kamrath IP Lawfirm, P.A.

(57) ABSTRACT

A series-connected fan unit includes a first fan frame, a second fan frame, a first motor, a second motor and two impellers. The first fan frame has a first base and a first positioning member coupled with the first base. The second fan frame is connected to the first fan frame in series and has a second base and a second positioning member coupled with the second base. The first motor is disposed in the first base and has a first circuit board coupled with the first positioning member. The second motor is disposed in the second base and has a second circuit board coupled with the second positioning member. The two impellers are respectively coupled with the first motor and the second motor, and an insulation area is formed between the first circuit board and the second circuit board.

11 Claims, 7 Drawing Sheets

SERIES-CONNECTED FAN UNIT

BACKGROUND OF THE INVENTION

1. Field of the Invention

The present invention generally relates to a series-connected fan unit and, more particularly, to a series-connected fan unit that has at least one circuit board coupled with at least one positioning member, respectively.

2. Description of the Related Art

Referring to FIG. 1, a conventional series-connected fan unit 9 is disclosed by Taiwanese Patent No. I322655 entitled "Circuit Board Holder, Dual Motor Apparatus, and Dual Fan Structure". The conventional series-connected fan unit 9 includes two cooling fans 91 and a circuit board holder 92. Both the cooling fans 91 have a motor 911, a circuit board 912 and a plurality of vanes 913. The circuit board 912 can start operation of the motor 911 which, in turn, drives the vanes 913 to rotate. The circuit board holder 92 is disposed between the two cooling fans 91 and consists of a base plate 921 and a plurality of supporters 922. The base plate 921 has two faces 923 opposite to each other. The supporters 922 are located on the base plate 921 and protrude from the two faces 923 of the base plate 921. In this arrangement, the supporters 922 can abut the two circuit boards 912 to prevent shaking of the circuit boards 912 resulting from vibration generated during operation of the two cooling fans 91.

In general, a distance D is present between the two circuit boards 912 when the two cooling fans 91 are connected in series. The circuit board holder 92 has a predetermined height H, which should be designed in a value substantially equal to the distance D in order for the supporters 922 to securely abut against the two circuit boards 912, respectively. If the two cooling fans 91 are connected too closely or the predetermined height H is accidentally designed to have a value larger than it is intended to be, the circuit board holder 92 will over abut against the two circuit boards 912 as the distance D is smaller than the predetermined height H. This not only causes damage of the two circuit boards 912 but also affects the coupling and positioning of internal components inside the conventional series-connected fan unit 9. On the contrary, if the two cooling fans 91 are not connected closely enough or the predetermined height H is accidentally designed to have a value smaller than it is intended to be, the circuit board holder 92 won't be able to reach and abut against the two circuit boards 912 as the distance D is larger than the predetermined height H. As a result, shaking and loosening of the two circuit boards 912 occur easily.

In light of the aforementioned problems, the conventional series-connected fan unit 9 generally has some drawbacks such as difficulty in securely positioning the circuit boards and a tendency in damaging the circuit boards during the assembly process. Thus, it is desired to improve the conventional series-connected fan unit 9.

SUMMARY OF THE INVENTION

It is therefore the primary objective of this invention to provide a series-connected fan unit having circuit boards securely positioned therein.

It is another objective of this invention to provide a series-connected fan unit which prevents circuit boards thereof from over-abutting against each other, thus avoiding damage of the circuit boards.

The invention discloses a series-connected fan unit comprising a first fan frame, a second fan frame, a first motor, a second motor and two impellers. The first fan frame has a first base and a first positioning member coupled with the first base. The second fan frame is connected to the first fan frame in series and has a second base and a second positioning member coupled with the second base. The first motor is disposed in the first base and has a first circuit board coupled with the first positioning member. The second motor is disposed in the second base and has a second circuit board coupled with the second positioning member. The two impellers are respectively coupled with the first motor and the second motor. An insulation area is formed between the first circuit board and the second circuit board.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
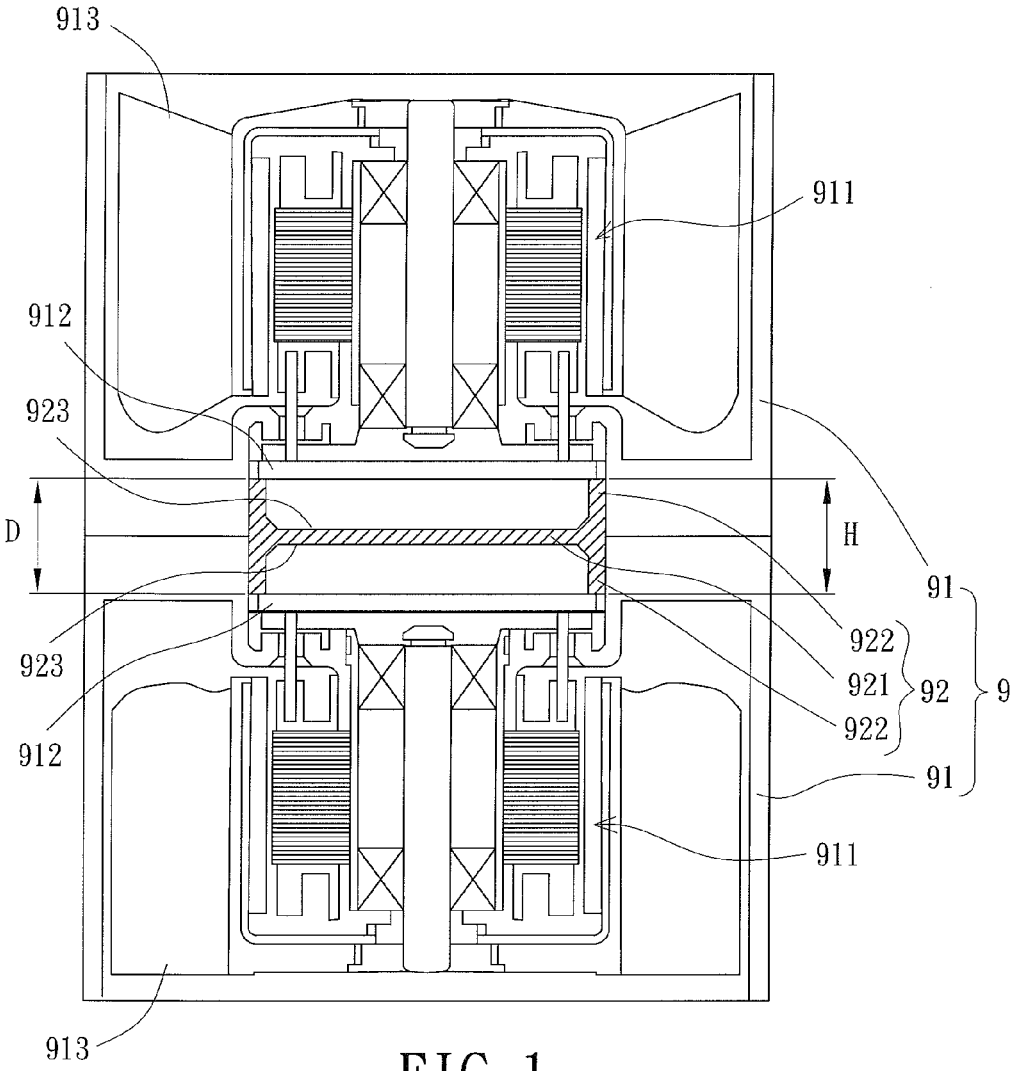
FIG. 1 PRIOR ART
FIG. 1 shows a cross-sectional diagram of a conventional series-connected fan unit.

In the various figures of the drawings, the same numerals designate the same or similar parts. Furthermore, when the terms "first", "second", "third", "fourth", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
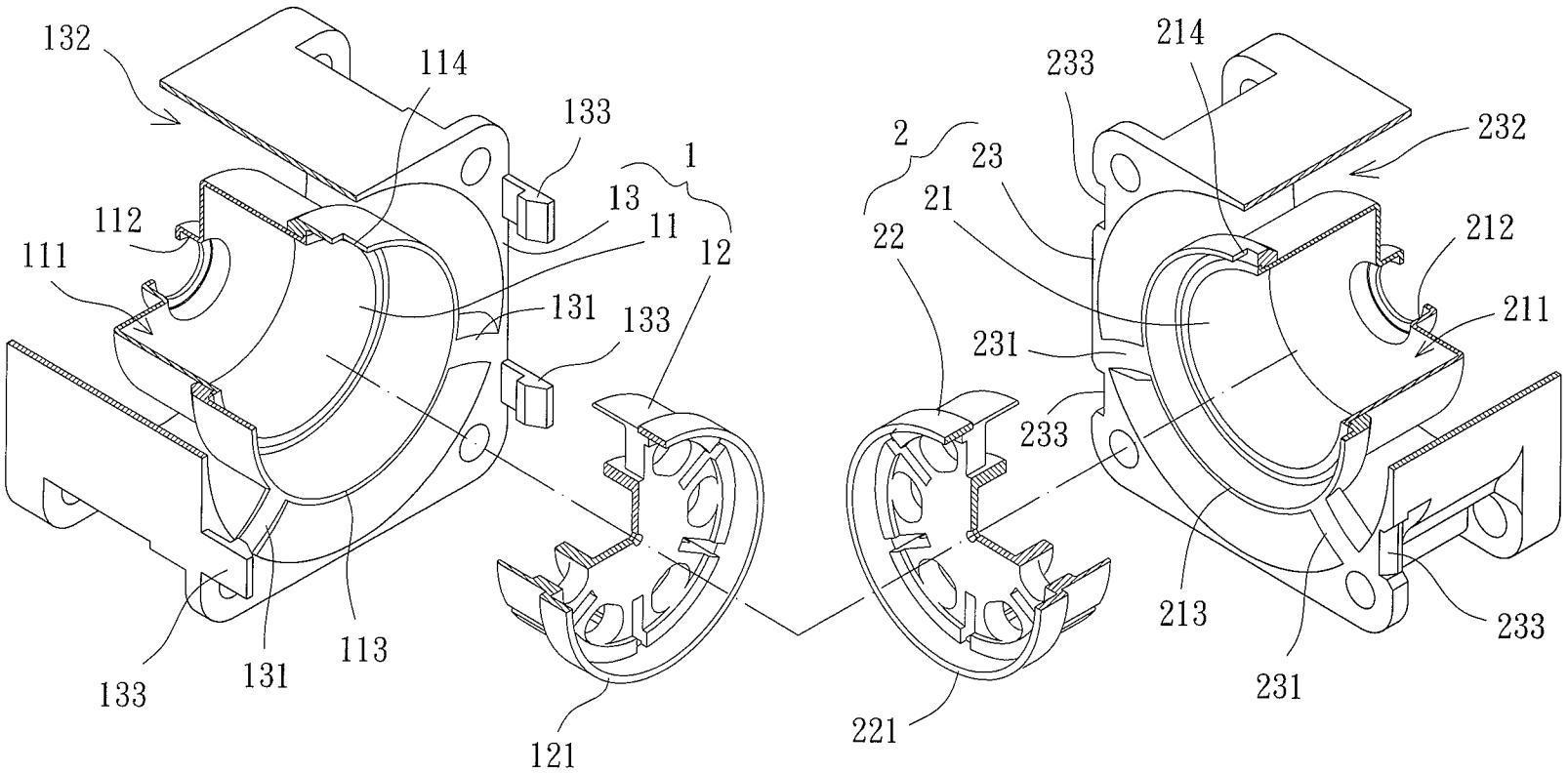
FIG. 2 shows an exploded diagram of a series-connected fan unit consisting of a first fan frame and a second fan frame according to a first embodiment of the invention.
Figure 3:
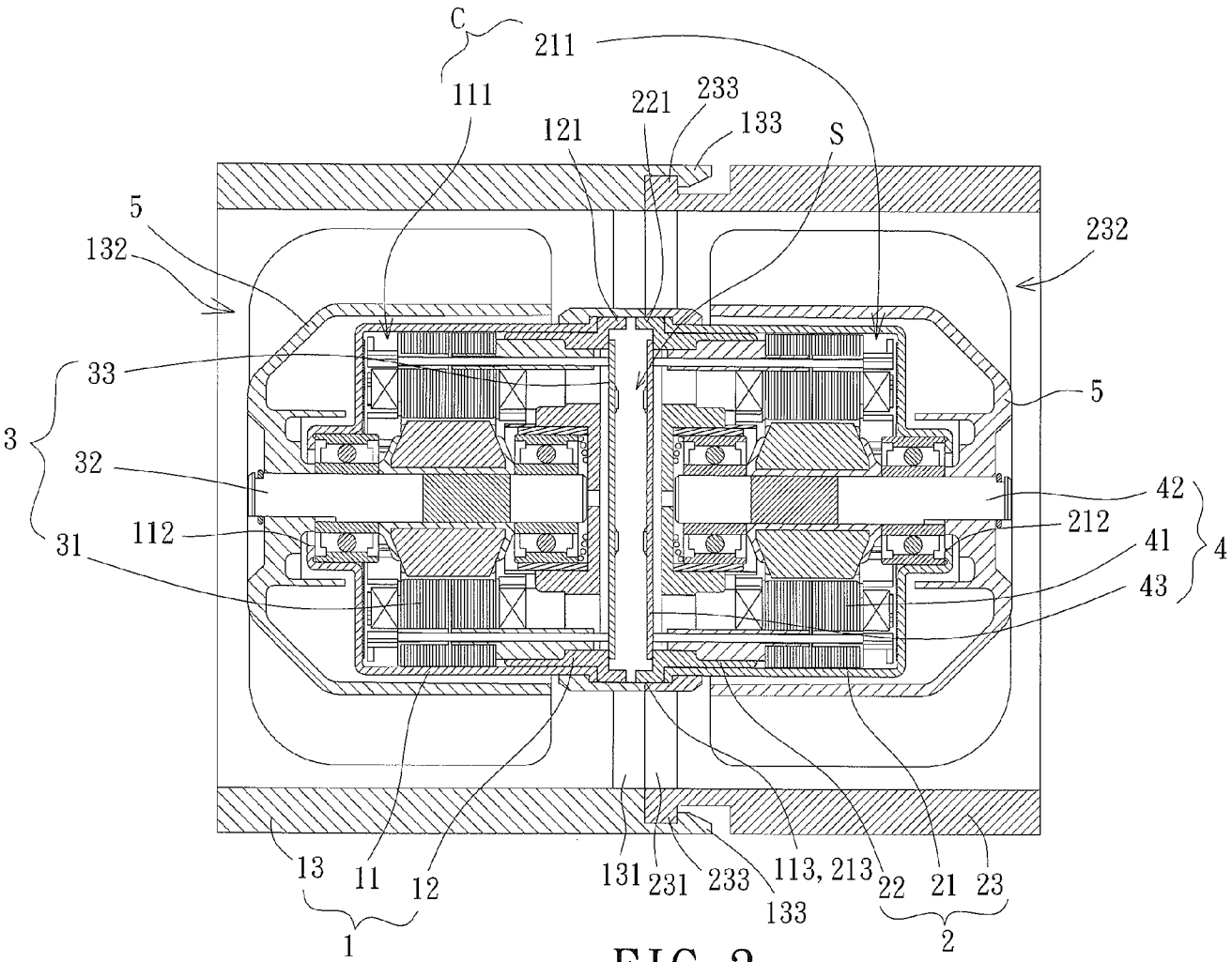
FIG. 3 shows a cross-sectional diagram of the series-connected fan unit according to the first embodiment of the invention.

Referring to FIGS. 2 and 3, a series-connected fan unit including a first fan frame 1, a second fan frame 2, a first motor 3, a second motor 4 and two impellers 5 is disclosed according to a first embodiment of the invention. The first fan frame 1 and the second fan frame 2 can be assembled in series to respectively receive the first motor 3 and the second motor 4. The two impellers 5 can be coupled with the first motor 3 and the second motor 4, respectively.

The first fan frame 1 includes a first base 11 and a first positioning member 12. The first base 11 is hollow and has a compartment 111 for receiving and positioning the first motor 3. The first base 11 further includes an axial hole 112 and an assembling opening 113 aligning and facing the second fan frame 2. Both the axial hole 112 and assembling opening 113 communicate with the compartment 111. The first base 11 may further include a wire outlet 114 adjacent to the assembling opening 113 for wires of a circuit board to be passed therethrough. The first positioning member 12 is disposed at the assembling opening 113 of the first base 11. The first positioning member 12 has a first insulated pressure-resistant portion 121 in the form of an annular wall as shown in FIG. 2. The first fan frame 1 further includes a first frame 13 surrounding and connecting to the first base 11 via a plurality of connection members 131 (such as ribs or stationary blades). Furthermore, the first frame 13 has a receiving room 132 in which the first base 11 is disposed.

The second fan frame 2 has substantially the same structures as the first fan frame 1. Specifically, the first base 11, compartment 111, axial hole 112, assembling opening 113, wire outlet 114, first positioning member 12, first insulated pressure-resistant portion 121, first frame 13, connection members 131 and receiving room 132 of the first fan frame 1 correspond to a second base 21, a compartment 211, an axial hole 212, an assembling opening 213, a wire outlet 214, a second positioning member 22, a second insulated pressure-resistant portion 221, a second frame 23, a plurality of connection members 231 and a receiving room 232 of the second fan frame 2. The components of the second fan frame 2 are connected together in the same way as those of the first fan frame 1, so it is not described herein again.

Moreover, the frame 13 of the first fan frame 1 has at least one coupling portion 133, and the second frame 23 of the second fan frame 2 has at least one coupling portion 233. The at least one coupling portion 133 and the at least one coupling portion 233 can be of any structure (such as buckles or screws) capable of securely assembling the first fan frame 1 and the second fan frame 2 in series to avoid disengagement or relative rotation therebetween. In this embodiment, each of the at least one coupling portion 133 of the first fan frame 1 is implemented as a buckling panel, and each of the at least one coupling portion 233 of the second fan frame 2 is implemented as a groove.

The first motor 3 is an inner-rotor-type motor including a stator 31, a rotor 32 and a first circuit board 33. The stator 31 includes a coil unit and is fixed in the compartment 111 of the first base 11. The rotor 32 is rotatably disposed in the stator 31 and includes components such as a shaft and a permanent magnet, as is well-known by one skilled in the art. The first circuit board 33 may be a conventional printed circuit board (PCB), and is coupled with the first positioning member 12 and electrically connected to the coil unit of the stator 31 to drive the rotor 32 to relatively rotate with respect to the stator 31. In particular, the first circuit board 33 in this embodiment is spaced from an end of the first insulated pressure-resistant portion 121 by a first distance while being coupled with the first positioning member 12.

The second motor 4 has substantially the same structures as the first motor 3. Specifically, the stator 31, rotor 32 and first circuit board 33 of the first motor 3 correspond to a stator 41, a rotor 42 and a second circuit board 43 of the second motor 4. Since the way the second motor 4 is disposed in the second fan frame 2 is the same as that the first motor 3 is disposed in the first fan frame 1, it is not described herein again.

The two impellers 5 are respectively coupled with the rotors 32, 42 of the first and second motors 3, 4, and are respectively located in the receiving rooms 132, 232 of the first and second fan frames 1, 2. Thus, when the two impellers 5 are rotating, external air can be drawn into one of the receiving rooms 132, 232, and heat can be expelled from the other of the receiving rooms 132, 232 for cooling purposes.

Referring to FIG. 3, when the series-connected fan unit of the invention is in assembly, the stator 31 and the rotor 32 of the first motor 3 can be disposed in the first base 11, and the stator 41 and the rotor 42 of the second motor 4 can be disposed in the second base 21. Based on this, the two impellers 5 are respectively coupled with the rotors 32, 42 of the first and second motors 3, 4, and the first and second circuit boards 33, 43 are respectively assembled to the first and second positioning members 12, 22. Then, the first and second positioning members 12, 22 are respectively coupled with the assembling openings 113, 213 of the first and second bases 11, 21, allowing the first and second circuit boards 33, 43 to be respectively electrically connected to the stators 31, 41 of the first and second motors 3, 4. Finally, the first and second fan frames 1, 2 are assembled in series via the at least one coupling portion 133 and at least one coupling portion 233, allowing the receiving rooms 132, 232 to communicate with each other, the first and second frames 13, 23 to abut against each other, and the first and second bases 11, 21 to also abut against each other. As such, secure coupling between the first fan frame 1 and the second fan frame 2 can be attained.

In such an arrangement, the compartments 111, 211 of the first and second bases 11, 21 may communicate with each other to define a common compartment C in which both the first and second positioning members 12, 22 are disposed. Based on this, an insulation area S may be formed between the first circuit board 33 and the second circuit board 43 to avoid a short circuit therebetween that is caused by interconnection of the first circuit board 33 and the second circuit board 43. More specifically, since the first circuit board 33 is spaced from an end of the first insulated pressure-resistant portion 121 by the first distance, as well as since the second circuit board 43 is spaced from an end of the second insulated pressure-resistant portion 221 by a second distance, the first and second distances may form the insulation area S for separating the first circuit board 33 from the second circuit board 43. Note the first and second distances can be the same or a different value.

Figure 4:
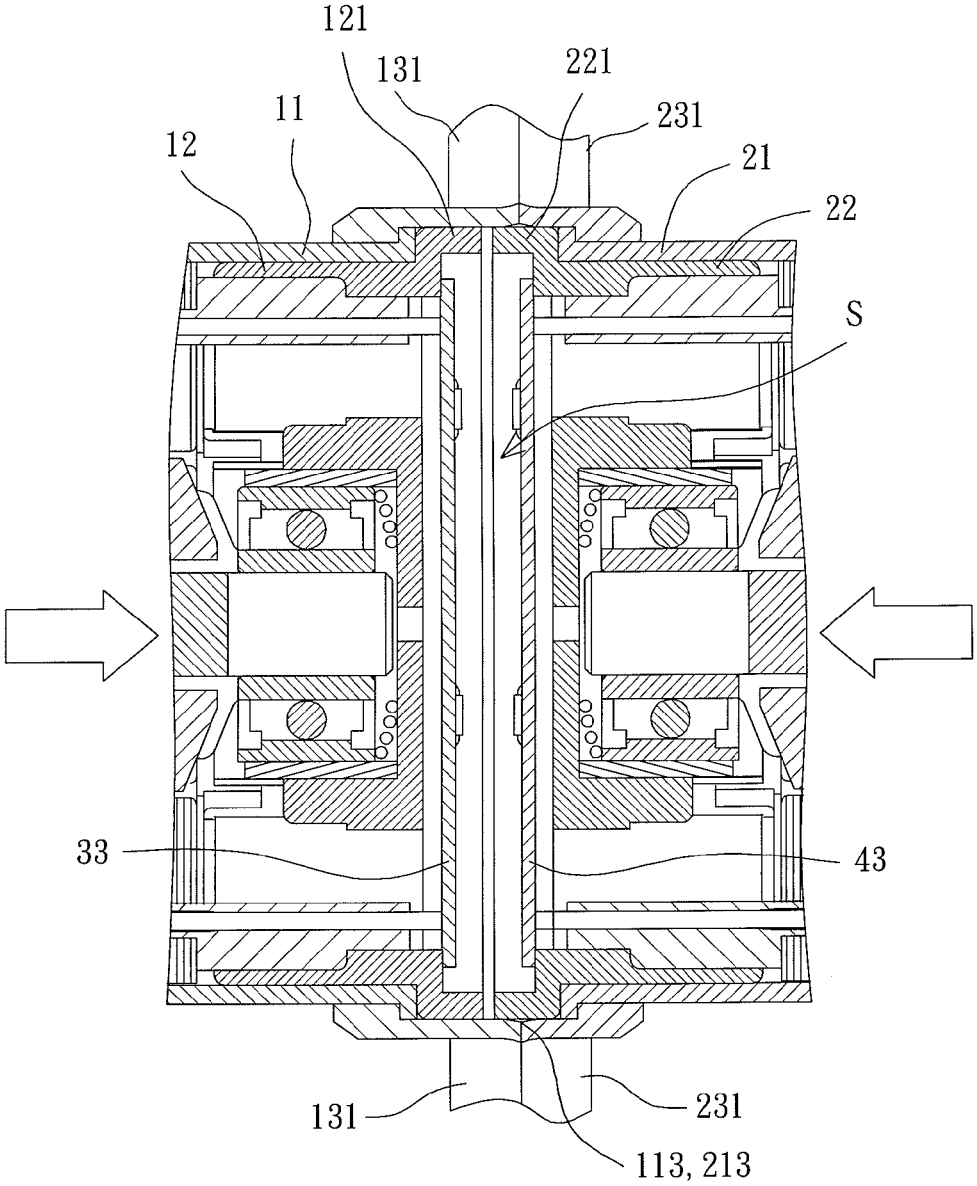
FIG. 4 shows a local enlarged cross-sectional diagram of the series-connected fan unit being assembled.

Referring to FIG. 4, to securely couple the at least one coupling portion 133 and at least one coupling portion 233 together, the pressure applied upon the first and second fan frames 1, 2 during assembly of the series-connected fan unit will cause slight deformation of two ends of the first and second bases 11, 21 (where the first base 11 and second base 21 abut against each other), pulling the first positioning member 12 and second positioning member 22 more closely to each other. To solve this problem, a gap is designed between the two ends of the first and second bases 11, 21 to prevent the first insulated pressure-resistant portion 121 and second insulated pressure-resistant portion 221 from over-abutting against each other. This prevents the first positioning member 12 and the second positioning member 22 from pushing each other out of the position due to mutual pressing therebetween, securing coupling and positioning between the first circuit board 33 and the first positioning member 12, as well as between the second circuit board 43 and the second positioning member 22. In another case where the at least one coupling portion 133 and the at least one coupling portion 233 are coupled together by way of screwing and the first fan frame 1 and the second fan frame 2 are over screwed with each other, the first base 11 and the second base 21 could still be slightly deformed due to the mutual pressing therebetween. However, the gap between the first insulated pressure-resistant portion 121 and the second insulated pressure-resistant portion 221 can provide a room for avoiding over-abutting between the first insulated pressure-resistant portion 121 and the second insulated pressure-resistant portion 221.

In contrast to the conventional series-connected fan unit 9 that uses the circuit board holder 92 to abut against the two circuit boards 912 and thus has disadvantages such as difficulty in securely positioning the two circuit boards 912 and tendency in damaging the two circuit boards 912 during assembly process of the conventional series-connected fan unit 9, the series-connected fan unit of the invention is characterized in using the first positioning member 12 and the second positioning member 22 to respectively position the first circuit board 33 and the second circuit board 43. This not only securely positions the first circuit board 33 and the second circuit board 43 but also separates the first circuit board 33 from the second circuit board 43 via the insulation area S. Thus, the series-connected fan unit of the invention has better positioning and insulation effects of the first circuit board 33 and the second circuit board 43. In addition, the first positioning member 12 and the second positioning member 22 can be kept away from each other or kept from over-abutting against each other during the assembly process by the gap between the first insulated pressure-resistant portion 121 and the second insulated pressure-resistant portion 221, preventing damage of the first circuit board 33 and the second circuit board 43.

Figure 5:
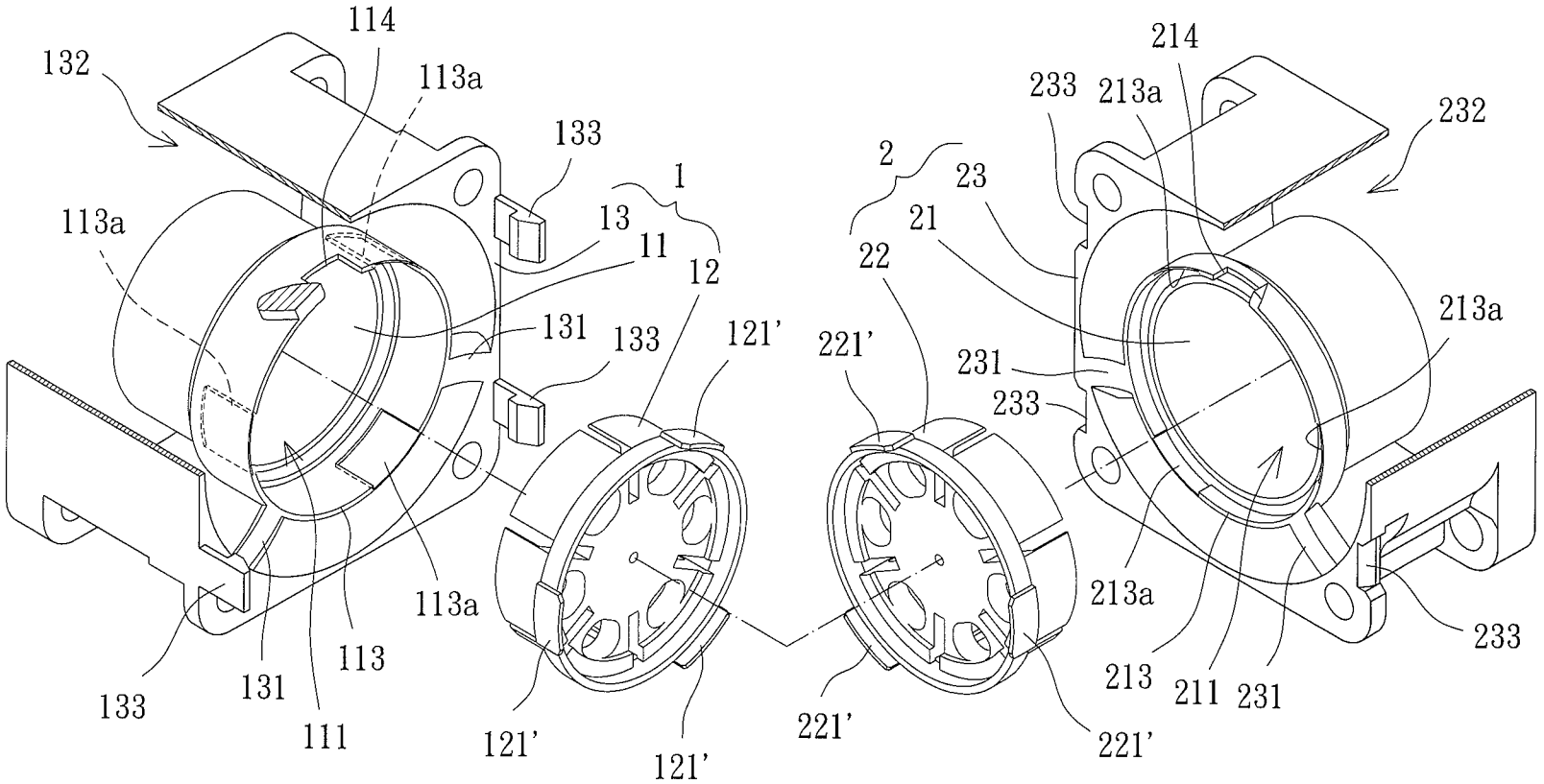
FIG. 5 shows an exploded diagram of a series-connected fan unit consisting of a first fan frame and a second fan frame according to a second embodiment of the invention.
Figure 6:
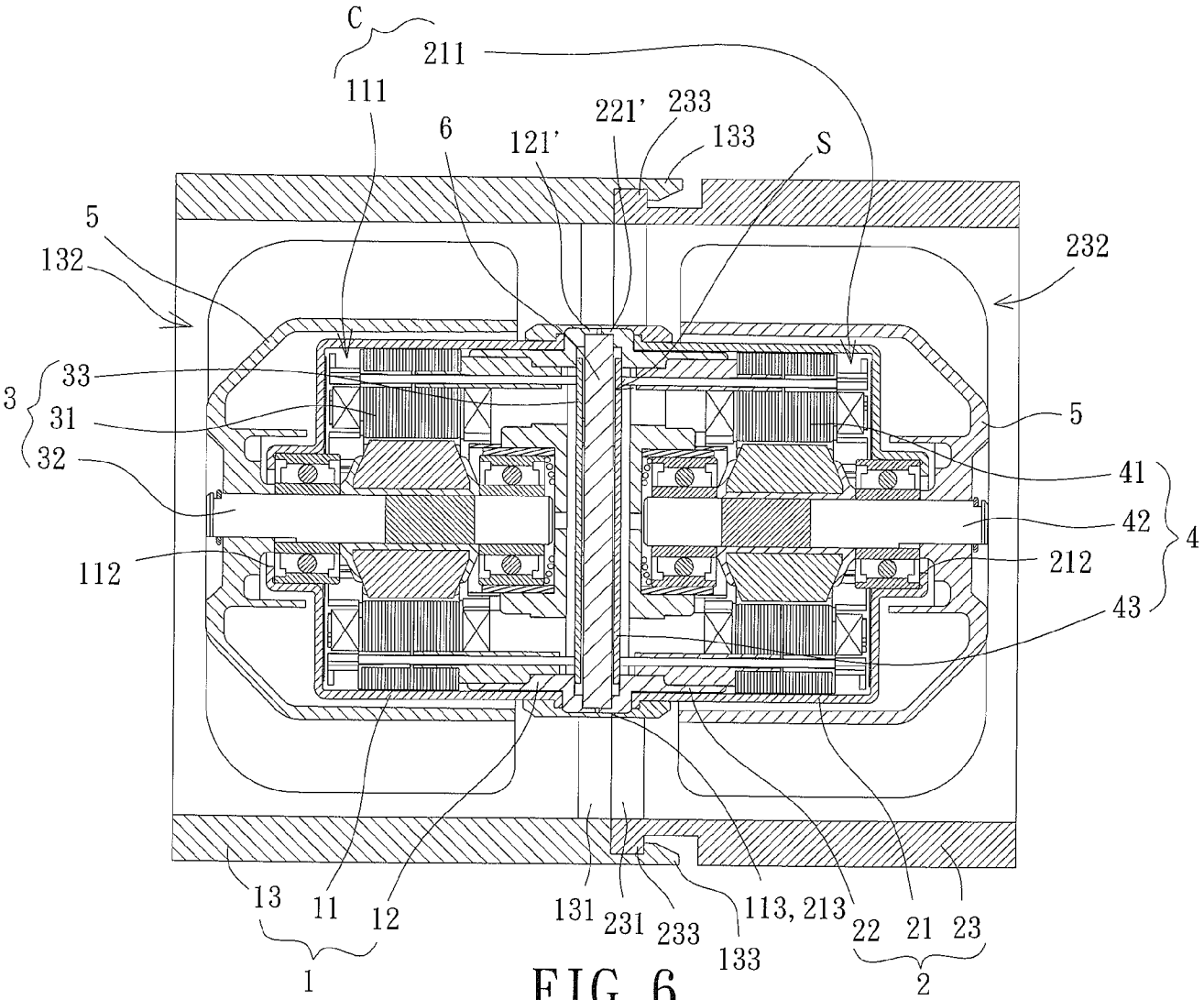
FIG. 6 shows a cross-sectional diagram of the series-connected fan unit according to the second embodiment of the invention.

Referring to FIGS. 5 and 6, a series-connected fan unit is disclosed according to a second embodiment of the invention. In comparison with the first embodiment, the series-connected fan unit in the second embodiment further comprises a buffering member 6, and the first positioning member 12 and the second positioning member 22 respectively include a first insulated pressure-resistant portion 121' and a second insulated pressure-resistant portion 221' in the form of a plurality of protrusions.

The buffering member 6 is located between the first circuit board 33 and the second circuit board 43 and has two faces abutting against the first circuit board 33 and the second circuit board 43, respectively. The buffering member 6 may be made of resilient insulation materials such as rubber, sponge, acrylic resin, silicon gel or other silicon gel compounded materials. In this way, the buffering member 6 not only can separate the first circuit board 33 from the second circuit board 43 to avoid electrical connection therebetween, but also can relieve the vibration that travels between the first positioning member 12 and the second positioning member 22 for better operation quality of the series-connected fan unit.

In this embodiment, the first distance is also present between the first circuit board 33 and an end of the protrusion of the first insulated pressure-resistant portion 121', and the second distance is also present between the second circuit board 43 and an end of the protrusion of the second insulated pressure-resistant portion 221'. Thus, the insulation area S is formed between the first circuit board 33 and the second circuit board 43 for separation purposes. Moreover, the first base 11 may further include a plurality of concavities 113*a* on an inner circumferential wall of the assembling opening 113, and the second base 21 may further include a plurality of concavities 213*a* on an inner circumferential wall of the assembling opening 213. To couple the first insulated pressure-resistant portion 121' with the second insulated pressure-resistant portion 221', the location and quantity of the concavities 113*a* and 213*a* should respectively correspond to the location and quantity of the protrusions of the first insulated pressure-resistant portion 121' and the second insulated pressure-resistant portion 221'. With the protrusions and concavities, the invention is not only able to respectively couple the first positioning member 12 and the second positioning member 22 to the assembling openings 113 and 213 for accurately positioning the first circuit board 33 and the second circuit board 43 outside the wire outlets 114 and 214 respectively, but is also able to improve the coupling and positioning between the first positioning member 12 and the first base 11, as well as between the second positioning member 22 and the second base 21.

Figure 7:
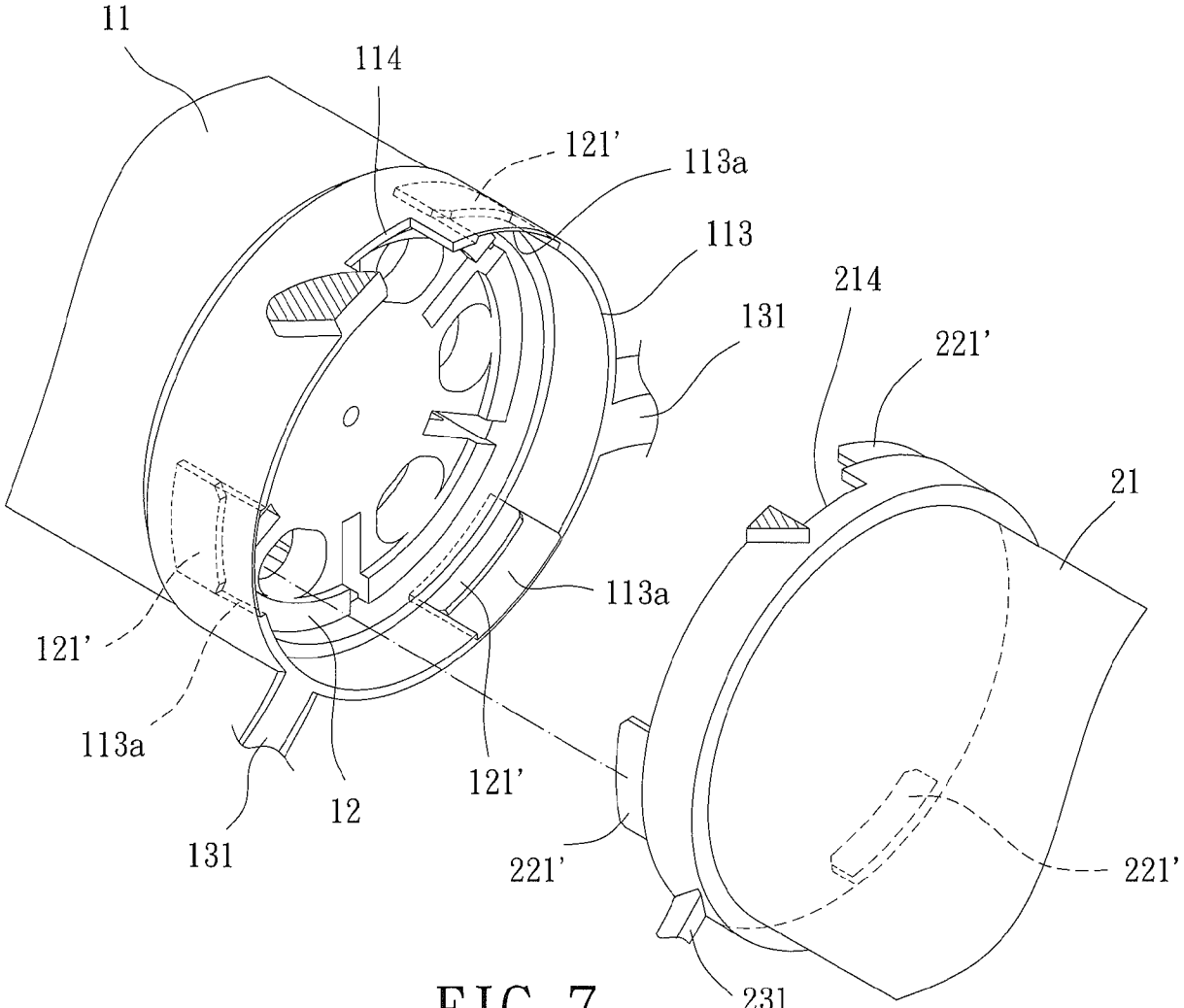
FIG. 7 shows a local enlarged diagram of a first positioning member and a second positioning member according to the second embodiment of the invention.

In particular, referring to FIG. 7, the protrusions of the first insulated pressure-resistant portion 121' and the second insulated pressure-resistant portion 221' are aligned with each other. In addition, the concavities 113*a* and 213*a* not only allow coupling between the first positioning member 12 and the first base 11, as well as between the second positioning member 22 and the second base 21, but also achieve assembly between the first fan frame 1 and the second fan frame 2. More specifically, the protrusions of the first insulated pressure-resistant portion 121' are received in a portion of the concavities 113*a*, whereas the protrusions of the second insulated pressure-resistant portion 221' protrude from the end of the assembling opening 213 to be inserted into the concavities 113*a* of the first base 11.

The series-connected fan unit of the second embodiment of the invention not only has a longer service life via usage of the buffering member 6 while providing the same functions as that of the first embodiment, but also further employs the protrusions and concavities to improve the coupling and positioning between the first positioning member 12 and the second positioning member 22 and to provide easy assembly between the first fan frame 1 and the second fan frame 2.

Since the first circuit board 33 and the second circuit board 43 are respectively coupled with the first positioning member 12 and the second positioning member 22 while the first circuit board 33 is spaced from the end of the protrusion of the first insulated pressure-resistant portion 121' by the first distance and since the second circuit board 43 is spaced from the end of the protrusion of the second insulated pressure-resistant portion 221' by the second distance, the insulation area S may be formed between the first circuit board 33 and the second circuit board 43 to avoid a short circuit therebetween, thereby improving the coupling and positioning of the first circuit board 33 and the second circuit board 43 and providing separation between the first circuit board 33 and the second circuit board 43.

Furthermore, the series-connected fan unit of the invention can keep the first positioning member 12 and the second positioning member 22 away from each other or prevents the first positioning member 12 and the second positioning member 22 from over-abutting against each other by the gap between the two ends of the first insulated pressure-resistant portion 121 and the second insulated pressure-resistant portion 221, preventing damage or loosening of the first circuit board 33 and the second circuit board 43 to attain secure coupling and positioning of internal components inside the series-connected fan unit.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A series-connected fan unit, comprising:

a first fan frame having a first base and a first positioning member coupled with the first base and a first insulated pressure-resistant portion extending from the first positioning member away from the first base, with the first insulated pressure-resistant portion having an end;

a second fan frame connected to the first fan frame in series and having a second base and a second positioning member coupled with the second base and a second insulated pressure-resistant portion extending from the second positioning member away from the second base;

a first motor disposed in the first base and having a first circuit board coupled with the first positioning member and intermediate the end of the first insulated pressure-resistant portion and the first positioning member, with the first pressure-resistant portion surrounding the first circuit board;

a second motor disposed in the second base and having a second circuit board coupled with the second positioning member and intermediate the end of the second insulated pressure-resistant portion and the second positioning member, with the second pressure-resistant portion surrounding the second circuit board;

two impellers respectively coupled with the first motor and the second motor;

an insulation area between the first circuit board and the second circuit board, wherein the first and second circuit boards are spaced from the ends of the first and second insulated pressure-resistant portions to form the insulation area; and a gap between the ends of the first and second insulated pressure-resistant portions.

2. The series-connected fan unit as claimed in claim 1, further comprising a buffering member located in the insulation area between the first positioning member and the second positioning member.

3. The series-connected fan unit as claimed in claim 2, wherein the buffering member is located between the first circuit board and the second circuit board.

4. The series-connected fan unit as claimed in claim 1, wherein each of the first and second insulated pressure-resistant portions is in the form of an annular wall.

5. The series-connected fan unit as claimed in claim 1, wherein each of the first and second insulated pressure-resistant portions is in the form of a plurality of protrusions.

6. The series-connected fan unit as claimed in claim 5, wherein each of the first and second bases has a plurality of concavities, the concavities of the first base respectively receive the protrusions of the first insulated pressure-resistant portion, and the concavities of the second base respectively receive the protrusions of the second insulated pressure-resistant portion.

7. The series-connected fan unit as claimed in claim 6, wherein each of the protrusions of the first insulated pressure-resistant portion is aligned with a respective one of the protrusions of the second insulated pressure-resistant portion.

8. The series-connected fan unit as claimed in claim 7, wherein the protrusions of the second insulated pressure-resistant portion are received in the concavities of the first base, respectively.

9. The series-connected fan unit as claimed in claim 1, wherein both the first and second fan frames have at least one coupling portion, and the at least one coupling portion of the first fan frame is coupled with the at least one coupling portion of the second fan frame.

10. The series-connected fan unit as claimed in claim 9, wherein the at least one coupling portion of the first fan frame is at least one buckling panel and the at least one coupling portion of the second fan frame is at least one groove.

11. The series-connected fan unit as claimed in claim 1, wherein the first and second circuit boards are spaced first and second distances from the ends of the first and second insulated pressure-resistant portions respectively, and wherein the first distance is equal to the second distance.

* * * * *